United States Patent [19]

Marriott

[11] Patent Number: 4,884,541

[45] Date of Patent: Dec. 5, 1989

[54] SPEED GOVERNOR FOR SMALL ENGINES

[75] Inventor: Lee W. Marriott, Ypsilanti, Mich.

[73] Assignee: Tecumseh Products Company, Tecumseh, Mich.

[21] Appl. No.: 296,489

[22] Filed: Jan. 12, 1989

[51] Int. Cl.[4] ..... F02D 11/10

[52] U.S. Cl. ..... 123/361; 123/352; 123/376

[58] Field of Search ..... 123/350–357, 123/342, 361, 376

[56] References Cited

U.S. PATENT DOCUMENTS

| | | | |
|---|---|---|---|
| 1,302,855 | 5/1919 | Robbins et al. . | |
| 1,941,500 | 1/1934 | Simmen . | |
| 2,011,859 | 8/1935 | Kalin . | |
| 2,176,739 | 10/1939 | Howard . | |
| 2,204,492 | 6/1940 | Heintz . | |
| 2,313,011 | 3/1943 | Duwe . | |
| 2,529,437 | 11/1950 | Weinberger | 123/376 X |
| 3,049,110 | 8/1962 | Kerr . | |
| 3,082,353 | 3/1963 | Cohen et al. | 123/372 X |
| 3,749,069 | 7/1973 | Reese . | |
| 3,767,972 | 10/1973 | Noddings et al. . | |
| 3,800,755 | 4/1974 | Klaiber et al. . | |
| 3,886,921 | 6/1975 | Hafner | 123/352 |
| 4,383,510 | 5/1983 | Nakamura et al. . | |
| 4,459,954 | 7/1984 | Slavik et al. . | |
| 4,517,942 | 5/1985 | Pirkey et al. . | |

*Primary Examiner*—Tony M. Argenbright

*Attorney, Agent, or Firm*—Albert L. Jeffers; John F. Hoffman; David L. Ahlersmeyer

[57] ABSTRACT

A speed regulating governor system is disclosed for a small internal combustion engine having a throttle valve the position of which affects the speed of the engine, wherein the governor system includes a mechanical proportional controller and an electromechanical integral controller. The throttle valve is mechanically linked to and controlled by a governor lever that is acted upon by opposing forces provided by a mechanical speed selector and a centrifugal flyweight apparatus which measures the engine speed. Additonally, a solenoid actuator is operably connected to the governor lever to apply a force thereto in response to a control signal generated by an electronic integral controller. The control signal is proportional to the time integral of the difference between a desired electrical speed input and the actual speed of the engine measured by an electrical signal generated by an alternator driven by the engine.

13 Claims, 1 Drawing Sheet

SPEED GOVERNOR FOR SMALL ENGINES

BACKGROUND OF THE INVENTION

The present invention relates to carburetor control systems for internal combustion engines and, more particularly, to such systems for small internal combustion engines which incorporate a speed regulating governor to maintain the speed of the engine relatively constant under different loading conditions.

Small internal combustion engines are used in a variety of applications, including lawnmowers, snowblowers, and engine-alternator sets, to drive a variable load at a controlled operator selected speed setting. For instance, in the use of a lawnmower powered by an internal combustion engine, it is desired that the selected speed of the engine remain relatively constant under a variety of loading conditions. Thus, whether the lawnmower encounters tall grass or short grass, the lawnmower speed which has been selected by the operator should remain constant. Likewise, in the case of an engine-alternator set, it is essential that the alternator output frequency, i.e., the engine drive speed, remain constant despite changes in the electrical loads connected to the alternator output.

In the conventional design of mechanical speed regulating governors for small internal combustion engines, a throttle valve is mechanically linked to a governor lever which is acted upon by opposing forces representing the desired engine speed and the actual engine speed. The force representing the desired engine speed is typically provided by a spring linkage between the governor lever and a manually operable control lever. The opposing force representing the actual engine speed is provided by either an air vane mechanism or a centrifugal flyweight mechanism sensitive to the engine speed. Controlled movement of the throttle valve in response to a change in the desired engine speed setting or the engine load is proportional to the difference between the desired speed and the actual engine speed. Accordingly, the mechanical speed regulating governors of the prior art exhibit proportional control of the engine speed.

A problem arises in the mechanical speed regulating governors of the prior art, in that proportional control of engine speed results in offset error, or "droop", which reduces the governed engine speed when a load is applied and also manifests itself following a change in the desired engine speed setting. For example, if an engine is operating at steady state at a given desired speed under a constant load, and then the desired speed setting is increased by a desired amount, the proportional controller is not able to increase the actual speed of the engine by the desired amount, but instead increases the engine speed by something less than the desired amount. Likewise, when an engine operating at steady state at a given desired speed experiences a positive load change, thereby reducing the engine speed, a proportional controller is not capable of restoring the engine speed to the original desired speed, but rather to some lesser speed due to offset. In some applications, the problem of "droop" is not critical because the operator may either accept the lower speed or compensate by further increasing the desired speed setting. However, in an automatic, constant speed application such as an engine-alternator set, the problem of offset is less tolerable.

While the problem of offset in proportional controllers can be minimized by increasing the gain of the controller, this solution is unsatisfactory because high gain will cause an unstable process. Accordingly, it is desired to provide a controller which responds initially with small gain to achieve stable control, and then changes to high gain to overcome offset. Such a technique is practiced in a proportional plus integral controller, wherein integral control consists of the time integral of the difference between the desired speed setting and the actual speed.

A speed regulating arrangement for an internal combustion engine is disclosed in U.S. Pat. No. 3,800,755, issued to Klaiber et al, wherein proportional plus integral control of an engine is accomplished by actuation of the engine's throttle valve by an electromagnet having a rotatable armature. The electromagnet is controlled by an electronic speed regulating circuit having a regulating stage which exhibits both proportional and integral feedback. Several problems are associated with the aforementioned electronic control of an internal combustion engine, including the inability of the engine to operate in the event of a failure of any of the system's components. Also, electromagnetic actuators having the necessary linear response characteristics to perform proportional plus integral control are relatively expensive and require considerable power, thereby adding to the expense of the associated control circuitry.

Accordingly, it is desired to provide a speed regulating governor for an internal combustion engine which overcomes the problems and disadvantages of the prior mechanical proportional control systems and electronic proportional plus integral control systems.

SUMMARY OF THE INVENTION

The present invention overcomes the problems and disadvantages of the above-described prior art speed regulating governors for small internal combustion engines, by providing an improved governor that incorporates a mechanical proportional controller and an electromechanical integral controller, whereby reliable proportional plus integral control of a small internal combustion engine is economically achieved.

In general, the invention provides a speed regulating governor apparatus for an internal combustion engine having a moveable throttle valve the position of which affects the speed of the engine. The position of the throttle valve is controlled by a mechanical output of a mechanical proportional controller, whereby the mechanical output is proportional to the difference between a desired engine speed and the actual engine speed. The position of the throttle valve is also affected by an electromechanical actuator responsive to the electrical output of an electronic integral control circuit, whereby the electrical output is proportional to the time integral of the difference between the desired engine speed and the actual engine speed.

More specifically, the invention provides, in one form thereof, an internal combustion engine having a throttle valve which is governed at a desired speed setting by a proportional controller. The proportional controller includes a mechanical desired engine speed setting and a mechanically operated air vane or centrifugal flyweight speed indicator, which apply opposing forces to the throttle plate. The offset or "droop" experienced by the proportional controller when the engine experiences a load change is corrected for by an electronic integral controller, comprising an electromechanical actuator applying a force to the throttle plate in response to an electrical control signal output from an electronic integral control circuit. The integral control circuit receives an electrical input signal from an alternator driven by the engine, to derive the actual speed of the engine. The control circuit also receives an electrical input signal representing the desired speed of the engine. The electrical control signal output is proportional to the time integral of the difference between the two electrical input signals.

An advantage of the speed regulating apparatus and method of the present invention, in one form thereof, is that an electromechanical proportional plus integral control speed governor is provided that incorporates a backup mechanical proportional control speed governor, in the event of an electrical component failure.

Another advantage of the speed regulating apparatus and method of the present invention, in one form thereof, is that proportional plus integral speed regulation of an internal combustion engine is provided in which an electromechanical actuator performs only integral control, thereby enabling less expensive manufacturing of the apparatus.

Yet another advantage of the speed regulating apparatus and method of the present invention is that offset or "droop" in a small internal combustion engine speed regulating governor is virtually eliminated without the need for an all electronic system.

A further advantage of the speed regulating apparatus of the present invention is that an engine already equipped with conventional mechanical proportional control may be easily modified to achieve proportional plus integral control.

The present invention provides, in one form thereof, a speed regulating apparatus for an internal combustion engine having a throttle valve the position of which affects the speed of the engine. The apparatus includes a speed selector for selecting a desired speed for the engine. Likewise, a speed monitor determines the actual speed of the engine. A mechanical proportional controller, responsive to the speed selector and the speed monitor, provides a mechanical output proportional to the difference between the desired speed and the actual speed. The mechanical output is operative to control the position of the throttle valve. An electronic integral controller, responsive to the speed selector and the speed monitor, provides an electrical control signal output proportional to the time integral of the difference between the desired speed and the actual speed. An electromechanical actuator, such as a linearly acting solenoid, is coupled to the throttle valve and has a control input connected to the electronic integral controller to receive the control signal output. The actuator controls the position of the throttle valve in dependence upon the electrical control signal output. Accordingly, the mechanical controller provides proportional control of the position of the throttle valve, and the electronic controller provides integral control of the position of the throttle valve. In one aspect of the invention, the mechanical proportional controller and the electronic integral controller include separate desired engine speed and actual engine speed inputs.

The invention further provides, in one form thereof, a method for governing the speed of an internal combustion engine at a predetermined speed, wherein the engine includes a throttle valve the position of which affects the speed of the engine. One step of the method according to the present invention is to control the coarse position of the throttle valve by applying a net actuating force thereto proportional to the difference between a mechanically produced force representing the desired speed of the engine and an opposing mechanically produced force representing the actual speed of the engine. A second step in the method is to control the fine position of the throttle valve by applying a force thereto from an electromechanical actuator controlled by an electrical control signal that is proportional to the time integral of the difference between a first electrical signal representing the desired engine speed and a second electrical signal representing the actual speed of the engine. In this manner, proportional plus integral speed control of the engine is accomplished, thereby eliminating offset or "droop" associated with prior art mechanical proportional controllers.

BRIEF DESCRIPTION OF THE DRAWINGS

The invention is further described hereinbelow, as to a specific embodiment, in conjunction with the following drawings.

DESCRIPTION OF THE PREFERRED EMBODIMENT

Figure 1:
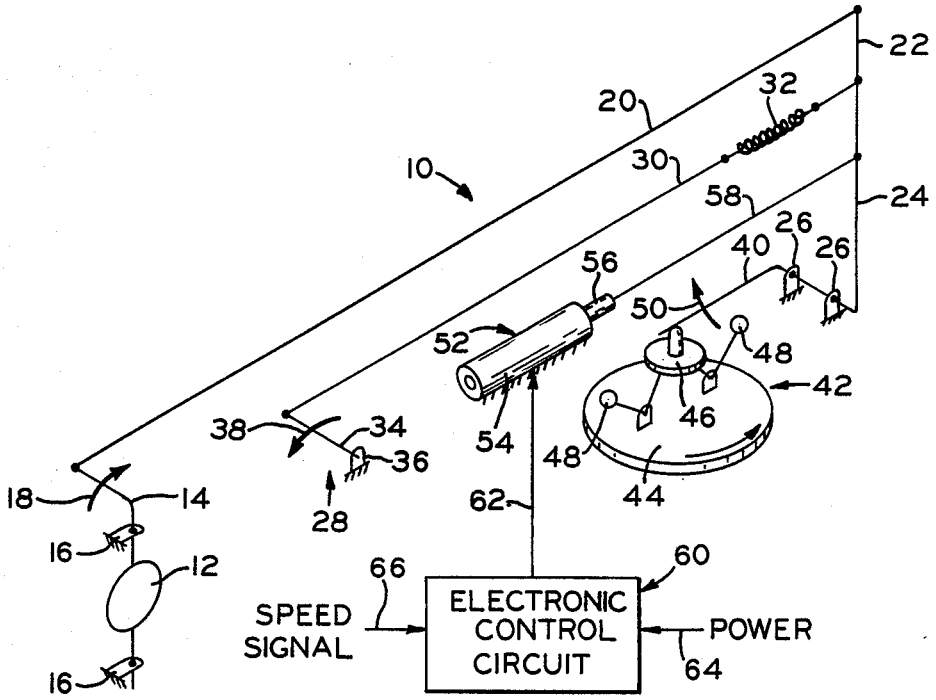
FIG. 1 is a diagrammatic representation of a speed regulating governor system for a small engine, in accordance with the principles of the present invention.

In an exemplary embodiment of the invention as shown in the drawings, and in particular by referring to FIG. 1, there is shown a speed regulating governor system of a small internal combustion engine, generally designated by the numeral 10. By way of illustration and not by way of limitation, the governor system is applied to a single cylinder, air cooled engine of the type adapted for use on a rotary lawnmower or an engine-alternator set. In such an engine, fuel is supplied to the engine by means of a carburetor, including a throttle valve which controls the fluid flow through an air-fuel mixture conduit of the carburetor. At the full open position of the throttle valve, the carburetor is set for running the engine at full speed; whereas, near the closed position of the throttle valve, the carburetor is set for low speed idle.

Small internal combustion engines commonly utilize a proportional control governor mechanism to regulate the speed of the engine about the desired speed setting in response to load changes experienced by the engine. As previously discussed, this is accomplished by an air vane or centrifugal flyweight engine speed sensing mechanism, the latter of which is shown and described in U.S. Pat. No. 4,517,942, assigned to the same assignee as the present invention. The proportional control governor mechanism incorporated herein is substantially identical to the one disclosed in greater detail in the above-cited U.S. Pat. No. 4,517,942, the disclosure of which is hereby incorporated herein by reference.

Referring once again to FIG. 1, governor system 10 includes a throttle comprising a throttle plate 12 mounted to a throttle lever 14 which is rotatably supported at pivots 16. Rotation of throttle plate 12 in the direction of arrow 18 is toward the closed position of the throttle, i.e., decreased engine speed. According to the preferred embodiment, throttle lever 14 is connected through a direct throttle linkage 20 to an upper portion 22 of a governor lever 24, which is pivotable at pivots 26. Upper portion 22 of governor lever 24 is also connected to a mechanical speed selector 28 by means of a governor spring linkage 30, including spring 32. Speed selector 28, according to the illustrated embodiment, comprises a speed set lever 34 pivotally mounted at one end thereof to pivot 36, and attached at the opposite end thereof to linkage 30. Movement of lever 34 in the direction of arrow 38 is toward a higher desired engine speed setting.

Referring again to governor lever 24, a lower portion 40 thereof is actuated upwardly and downwardly by a conventional centrifugal flyweight governor mechanism 42, whereby governor lever 24 pivots about pivots 26 resulting in corresponding movement of upper portion 22. Mechanism 42, according to conventional design, includes a rotatable gear 44 which is driven in a well-known manner by any speed responsive engine member, such as an engine camshaft timing gear. Such an arrangement is described in greater detail in the above-cited U.S. Pat. No. 4,517,942. Mounted on gear 44 and rotatable therewith is a spool 46 which contacts lower portion 40 of governor lever 24. Spool 46 is also operably linked to a pair of flyweights 48, which move radially outwardly in response to the increased centrifugal force caused by increased rotational speed of gear 44, i.e., increased engine speed. As flyweights 48 move radially outwardly, spool 46 moves upwardly in contact with lower portion 40, thereby causing lower portion 40 to move in the direction of arrow 50 representing increased engine speed.

The portion of governor system 10 described thus far constitutes a mechanical proportional control speed regulator, which operates as follows. The position of lever 34 represents a desired engine speed, and provides a force on governor lever 24 by virtue of governor spring linkage 30, including spring 32. With the engine running, mechanical governor mechanism 42 produces a force dependent upon the speed of the engine, which acts on governor lever 24 to oppose the force representing the desired speed setting. Accordingly, steady state regulated operation of the engine is achieved when the net force acting on governor lever 24 is substantially zero. In the event of a change in the desired speed setting or a change in engine loading, i.e., a change in the actual engine speed, a net force is applied to governor lever 24 and throttle lever 14 through linkage 20, thereby opening or closing the throttle in an effort to restore the desired speed setting. The net force is proportional to the difference between the desired engine speed setting and the actual engine speed.

In accordance with the principles of the present invention, governor system 10 further provides electromechanical integral control to compensate for the offset error or "droop" that is inherent in the mechanical proportional control portion of the system. Specifically, an electromechanical actuator 52, having a stationary electrical winding 54 and an armature 56, is operably connected to upper portion 22 of governor lever 24 through linkage 58, as shown in FIG. 1. An electronic integral control circuit 60 produces an electrical control signal output 62, which is connected to winding 54 to control the current thereto. Electromechanical actuator 52 is preferably a substantially linear acting solenoid, wherein the force imparted by armature 56 to governor lever 24 remains proportional to the current provided at output 62 throughout the operable range of the solenoid. It should be noted that actuator 52 is providing only the integral element of control and, therefore, is not required to respond in the same manner and generate the same forces as precision solenoids used in prior art electronically controlled proportional and integral control system. Accordingly, a less expensive solenoid may be employed. For instance, in an exemplary embodiment of the present invention, actuator 52 comprises a LEDEX Size 100, Model No. 174412-028 solenoid.

Figure 2:
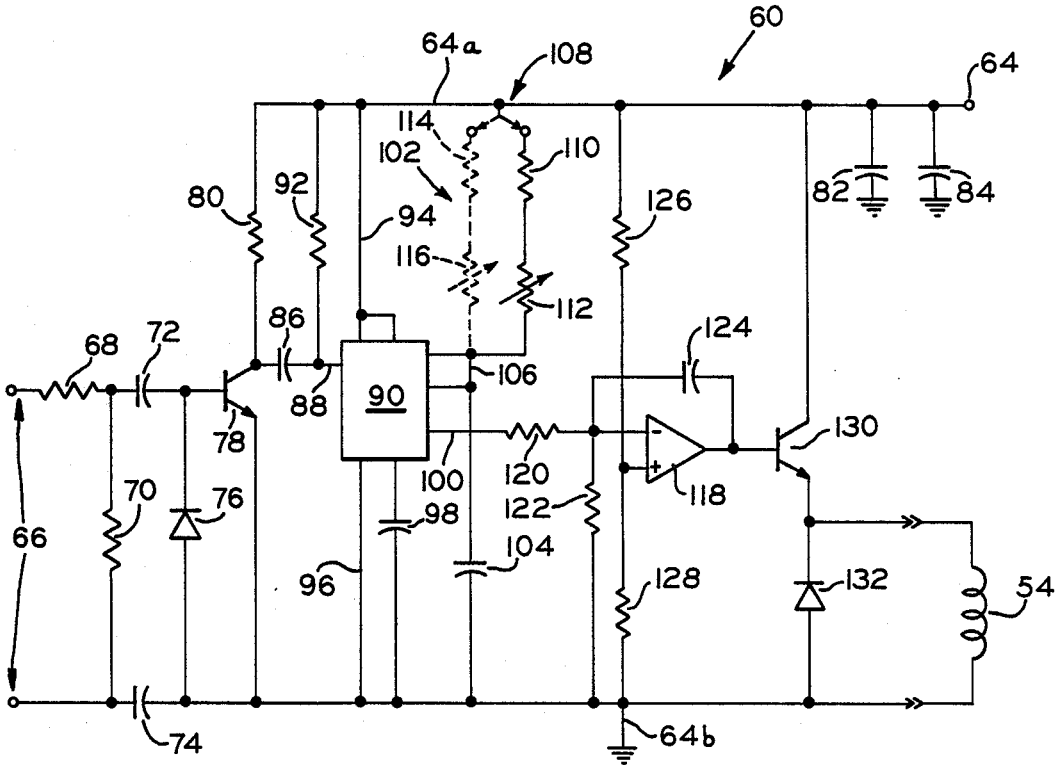
FIG. 2 is a circuit diagram of the electronic integral controller of the governor system of FIG. 1.

Referring now to control circuit 60, in addition to having control output signal 62, there are two electrical input signals; namely, a D.C. supply voltage input 64 and an A.C. speed signal input 66 having a frequency proportional to the speed of the engine. As shown in FIG. 2, D.C. supply voltage input 64 comprises a positive terminal **64*a* and a ground terminal 64*b*. In one embodiment of the invention, both inputs 64 and 66 are provided by a conventional engine-driven alternator having a stator winding output, wherein A.C. signal input 66 is taken directly from the stator winding output, while D.C. input 64 is a rectified, regulated D.C. output suitable for connection to a storage battery for charging thereof. Depending upon the number of poles passing by and inducing a voltage in the stator winding, the A.C. input 66 will have a given number of cycles per revolution of the engine crankshaft. In one embodiment, A.C. input 66** is derived from an eight pole alternator of the type used on Tecumseh engine Model No. OH-160, which produces eight cycles per revolution of the engine crankshaft.

Referring now to FIG. 2 for a detailed description of circuit 10, A.C. input signal 66 is coupled to the circuit by means of an isolation network comprising resistors 68 and 70 and capacitors 72 and 74. The A.C. voltage across resistor 70 is applied to the parallel combination of diode 76 and the base-emitter junction of a bipolar transistor 78. In this manner, a half-wave rectified triggering signal is applied to the transistor. Transistor 78 is in a common-emitter configuration, having a pull-up resistor 80 connected between the collector and positive terminal **64*a*. Incidentally, a pair of filtering capacitors 82 and 84 are provided at the D.C. power supply input to circuit 60**.

Referring once again to transistor 78, the collector is coupled by means of a capacitor 86 to the triggering input 88 of a monostable multivibrator 90, i.e., a "one-shot". Triggering input 88 is connected to positive terminal **64*a* through a biasing resistor 92 so as to ordinarily hold the input high. However, when transistor 78 conducts in response to a positive half-wave of A.C. input signal 66, the collector voltage is pulled toward ground, thereby dropping the voltage at triggering input 88 below a threshold trigger level of multivibrator 90. In the preferred embodiment, multivibrator 90 is a Signetics NE555 monostable multivibrator. Power is supplied to multivibrator 90 by means of a positive voltage connection 94 and a ground connection 96. A noise bypass capacitor 98 is also provided between a terminal of multivibrator 90 and ground terminal 64*b***.

The output of multivibrator 90 in response to a triggering input pulse appears at an output terminal 100, and is in the form of a pulse having a width dependent upon a time constant determined by a series RC network. More specifically, a resistance 102 and a capacitor 104 are connected in series between positive terminal **64*a* and negative terminal 64*b*, whereby a junction 106 therebetween is connected to multivibrator 90, as shown in FIG. 2. Resistance 102 is selectable by means of switch 108, which places into the series RC network either a series connected resistor 110** and potentiometer 112, or a series connected resistor 114 and potentiometer 116. The significance of choosing between either of the aforementioned series connected resistors and potentiometers will be further explained hereinafter.

Referring once again to output terminal 100 of multivibrator 90, the output signal thereat comprises a train of pulses having constant amplitude and constant width, whereby the frequency of the pulses is determined by the triggering pulses of A.C. input signal 66, i.e., the speed of the engine. Output terminal 100 is connected to the inverting input of an operational amplifier 118 through a voltage divider comprising resistors 120 and 122. Operational amplifier 118 is configured as an integrator, in as much as a capacitor 124 is connected between the inverting input and the output terminal thereof. A voltage divider, comprising resistors 126 and 128 connected in series between positive terminal 64*a* and ground terminal 64*b*, provides a reference input voltage at the junction therebetween for application to the noninverting input of operational amplifier 118.

In the above-described configuration of operational amplifier 118, the output signal is proportional to the time integral of the difference between the signals at the inverting and noninverting inputs. Therefore, the output of amplifier 118 at any given point in time depends on the history of the inputs, and is therefore capable of achieving a continuous range of substantially steady state outputs for the sake of providing offset correction, or reset, in speed regulating governor system 10. In fact, the output of amplifier 118 at steady state varies slightly about an average value in triangular fashion, due to the pulse input signal to the inverting input. The value of capacitor 124 determines the reset time of control system 10, or the rate at which the gain increases.

The output of operational amplifier 118 is connected to the base of a power bipolar transistor 130, which is operating within its saturation region. The collector of transistor 130 is connected to positive terminal 64*a*, and the emitter is connected to ground terminal 64*b* through the parallel combination of a diode 132 and winding 54 of electromechanical actuator 52. In this configuration, transistor 130 functions as a voltage controlled current source to power winding 54 in dependence upon the output of operational amplifier 118. Diode 132 protects transistor 130 against transient currents generated by inductive winding 54.

In operation of electronic integral control circuit 60, A.C. input signal 66, the frequency of which is dependent upon the actual speed of the engine, is conditioned and amplified through transistor 78 to provide triggering pulses to monostable multivibrator 118. Multivibrator 118, in turn, produces an output pulse of a constant amplitude and width for each triggering pulse received. The width of the output pulses is determined by the values of capacitor 104 and resistance 102. The output pulse train is delivered to the inverting input of operational amplifier 118, and is compared to a reference voltage applied to the noninverting input thereof. By virtue of feedback capacitor 124, the output of amplifier 118 is proportional to the time integral of the difference between its inputs. This output is then applied to the base of transistor 130 to control the drive current to winding 54 of actuator 52, thereby controlling the force exerted by armature 56 on governor lever 24.

In operation of the speed regulating governor system 10, in accordance with the preferred embodiment disclosed herein, the earlier described mechanical speed governor provides proportional control and the latter described electromechanical speed governor provides integral control, or reset, to correct the offset error inherent in the mechanical proportional controller when responding to an engine load change. In a preferred use of the governor system 10 of the present invention, the engine speed is regulated to a constant speed, as would be required in an engine-alternator set to maintain the proper frequency of the alternator output. Accordingly, in response to an engine load change, e.g., additional electrical load being applied to the alternator, it would be desirable to provide initial low gain proportional control by means of the mechanical proportional controller, and subsequent high gain integral or reset control provided by the electromechanical integral controller, which would compensate for offset error inherent in proportional control. Furthermore, the mechanical proportional controller would alone provide acceptable engine speed regulation under most circumstances, in the event of a failure of the electromechanical integral controller. The mechanical proportional control regulator would operate in the event of any component failure of the electromechanical regulator, except if transistor 130 shorts out and drives actuator 52 full on.

To initially set up governor system 10 in the aforementioned engine-alternator application, it is recommended that the electromechanical integral governor be disabled and that mechanical speed selector be adjusted until the engine, without any load, is regulated by the mechanical proportional governor to run at the desired speed. Under these steady state conditions, enablement of the electromechanical integral controller should not produce any additional force on governor lever 24. Accordingly, circuit 60 should be set up initially to produce a substantially zero drive current output to winding 54 of actuator 52. This is accomplished by establishing substantially equal inputs to the inverting and noninverting inputs of operational amplifier 118. For instance, the average voltage of the inverting input, i.e., the pulse signal appearing at output 100 of multivibrator 90, is made substantially equal to the reference voltage applied the noninverting input by adjusting resistance 102 to increase or decrease the width of each output pulse. Where the engine is used to drive an alternator operable at two different speeds, resistance 102 may comprise two selectable resistances, one comprising resistor 110 and potentiometer 112, and the other comprising resistor 114 and potentiometer 116.

Once governor system 10 is initially set up to run at a constant speed, as described herein, it can be seen that the addition of a load to the engine will result in an initial decrease in actual engine speed. The mechanical proportional regulator will respond by applying a net force to governor lever 24 proportional to the difference between the desired speed setting determined by mechanical speed selector 28 and the actual engine speed as measured by mechanical governor mechanism 42. The force will be in a direction to open throttle valve 12.

Because of offset, the mechanical proportional regulator will be unable to restore the engine speed to the desired speed. However, concurrent with the operation of the mechanical proportional regulator, the electromechanical integral regulator senses a speed decrease reflected at A.C. input signal 66*a*. This causes fewer pulses of constant amplitude and pulse width to be applied at the inverting input of amplifier 118, resulting in a smaller average voltage for comparison with the reference value. Accordingly, the amplifier 118 integrates the difference to produce an output which drives transistor 130 to deliver increasingly more current to actuator 52. In turn, armature 56 applies a force to governor lever 24, which opens the throttle further to increase the speed of the engine so as to attain the desired speed and compensate for offset, i.e., reset speed regulating governor 10 is reset for the new load condition.

Regarding the response of circuit 10 to changes in D.C. supply voltage 64, it should be noted that the circuit is self compensating. More specifically, a change in voltage 64 results in offsetting changes to the reference voltage at the noninverting input of operational amplifier 118, and the amplitude of the pulses applied to the inverting input.

It will be appreciated that while speed regulating governor system 10 has been described with respect to a constant desired speed application, an adjustable desired speed system exhibiting proportional plus integral control may be achieved by making resistance 102 adjustable by an operator to increase or decrease the desired speed setting. Mechanical speed selector 28 could remain constant, thereby requiring greater forces from actuator 52 as the desired engine speed would increase above the initial mechanical setting. It should be noted that in this arrangement, failure of the electromechanical integral controller would result in a mechanical proportional control regulator, the desired speed of which would have to be set on mechanical speed selector 28.

It will be appreciated that the foregoing is presented by way of illustration only, and not by way of any limitation, and that various alternatives and modifications may be made to the illustrated embodiment without departing from the spirit and scope of the invention.

What is claimed is:

1. A speed regulating apparatus for an internal combustion engine having a throttle valve the position of which affects the speed of the engine, comprising:

speed selecting means for selecting a desired speed for the engine;

speed monitoring means for determing the actual speed of the engine;

mechanical proportional control means, responsive to said speed selecting means and said speed monitoring means, for providing a mechanical output proportional to the difference between said desired speed and said actual speed, said mechanical output being operative to control the position of the throttle valve;

electronic integral control means, responsive to said speed selecting means and said speed monitoring means, for providing an electrical control signal output proportional to the time integral of the difference between said desired speed and said actual speed; and electromechanical means, coupled to said throttle valve and having a control input connected to said electronic integral control means to receive said control signal output, for controlling the position of said throttle valve in dependence upon said electrical control signal output, whereby said mechanical control means provides proportional control of the position of the throttle valve and said electronic control means provides integral control of the position of the throttle valve.

2. The speed regulating apparatus of claim 1 in which said electromechanical means comprises a substantially linear acting solenoid.

3. The speed regulating apparatus of claim 1 in which:

said speed selecting means comprises a mechanical speed selector associated with said mechanical proportional control means, and a separate electronic speed selector associated with said electronic integral control means.

4. The speed regulating apparatus of claim 1 in which:

said speed monitoring means comprises a mechanical speed indicator associated with said mechanical proportional control means, and a separate electronic speed indicator associated with said electronic integral control means.

5. The speed regulating apparatus of claim 1 in which:

said mechanical output of said mechanical proportional control means comprises a moveable governor lever mechanically coupled to the throttle valve, said governor lever being acted upon by opposing forces provided by said speed selecting means and said speed monitoring means.

6. The speed regulating apparatus of claim 5 in which:

said electromechanical means comprises a substantially linear acting solenoid actuator, including an armature operably coupled to said governor lever to apply a force thereto in response to said electrical control signal output of said electronic integral control means.

7. In combination with an internal combustion engine having a throttle valve the position of which affects the speed of the engine, wherein the engine includes a proportional control speed governor comprising mechanical means for adjusting the position of the throttle valve by applying a force thereto proportional to the difference between a mechanical engine speed setting and a mechanically determined actual engine speed, whereby the proportional control speed governor experiences control offset error in response to changes in engine loading conditions, an electronic integral controller, comprising:

electronic speed selecting means for selecting a desired engine speed;

electronic speed monitoring means for determining the actual engine speed; and electromechanical integral control means, responsive to said speed selecting means and said speed monitoring means, for applying a force to the throttle valve proportional to the time integral of the difference between said electronically selected desired engine speed and said electronically determined actual engine speed, whereby control offset error of the proportional control speed governor is substantially eliminated and the speed of the engine is maintained substantially at said electronically selected desired engine speed, despite changes in engine loading conditions.

8. The combination of claim 7 in which:

said electromechanical integral control means comprises a substantially linear acting solenoid mechanically coupled to the throttle valve and operable to apply a force thereto.

9. The combination of claim 7 wherein the engine includes a moveable governor lever mechanically coupled to the throttle valve and acted upon by opposing forces representing the mechanical engine speed setting and the mechanically determined actual engine speed, in which:

said electromechanical integral control means applies a force to the governor lever.

10. The combination of claim 9 in which:

said electromechanical integral control means comprises an electronic control circuit means, responsive to said electronic speed selecting means and said electronic speed monitoring means, for providing an electrical control signal output proportional to the time integral of the difference between said electronically selected desired engine speed and said electronically determined actual engine speed, and a substantially linear acting solenoid actuator, including an armature operably coupled to said governor lever to apply a force thereto in response to said electrical control signal output.

11. A method for governing the speed of an internal combustion engine at a predetermined speed, wherein the engine includes a throttle valve the position of which affects the speed of the engine, comprising the steps of:

controlling the coarse position of the throttle valve by applying a net actuating force thereto proportional to the difference between a mechanically produced force representing the desired speed of the engine and an opposing mechanically produced force representing the actual speed of the engine; and controlling the fine position of the throttle valve by applying a force thereto from an electromechanical actuator controlled by an electrical control signal that is proportional to the time integral of the difference between a first electrical signal representing the desired engine speed and a second electrical signal representing the actual speed of the engine.

12. The method of claim 11 in which:

said electromechanical actuator is a substantially linear acting solenoid actuator, including an armature mechanically coupled to the throttle valve.

13. The method of claim 11 wherein the engine includes a moveable governor lever mechanically coupled to the throttle valve, in which:

said step of controlling the coarse position of the throttle valve is performed by applying said net actuating force to the governor lever; and said step of controlling the fine position of the throttle valve is performed by applying said force from said electromechanical actuator to the governor lever.

* * * * *